US006789523B2

(12) United States Patent
Oki et al.

(10) Patent No.: US 6,789,523 B2
(45) Date of Patent: Sep. 14, 2004

(54) FAILURE DIAGNOSIS APPARATUS FOR EVAPORATIVE FUEL PROCESSING SYSTEM

(75) Inventors: Hideyuki Oki, Wako (JP); Eisaku Gosho, Wako (JP); Takashi Isobe, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 202 days.

(21) Appl. No.: 10/246,732

(22) Filed: Sep. 19, 2002

(65) Prior Publication Data

US 2003/0061871 A1 Apr. 3, 2003

(30) Foreign Application Priority Data

Oct. 3, 2001 (JP) ..... 2001-307041

(51) Int. Cl.[7] ..... F02B 77/00
(52) U.S. Cl. ..... 123/198 D; 123/520
(58) Field of Search ..... 123/198 D, 520, 123/516, 518, 519; 73/116, 117.3, 118.1; 701/101, 107, 112

(56) References Cited

U.S. PATENT DOCUMENTS 5,299,545 A * 4/1994 Kuroda et al. ..... 123/520
5,396,873 A * 3/1995 Yamanaka et al. ..... 123/520
5,450,834 A * 9/1995 Yamanaka et al. ..... 123/520
5,775,307 A * 7/1998 Isobe et al. ..... 123/520
6,227,035 B1 * 5/2001 Rice et al. ..... 73/37.9
6,467,463 B2 * 10/2002 Kitamura et al. ..... 123/516
6,564,780 B2 * 5/2003 Hanai et al. ..... 123/520

FOREIGN PATENT DOCUMENTS

JP Hei 11-336626 7/1999

* cited by examiner

*Primary Examiner*—Mahmoud Gimie
(74) *Attorney, Agent, or Firm*—Arent Fox PLLC

(57) ABSTRACT

A failure diagnosis apparatus for diagnosing a failure in an evaporative fuel processing system is disclosed. The evaporative fuel processing system has a fuel tank, a canister containing an adsorbent for adsorbing evaporative fuel generated in the fuel tank, an air passage connected to the canister and communicating with the atmosphere, a first passage for connecting the canister and the fuel tank, a second passage for connecting the canister and an intake system of an internal combustion engine, a vent shut valve for opening and closing the air passage, and a purge control valve provided in the second passage. The purge control valve and the vent shut valve are closed when stoppage of the engine is detected and it is determined whether there is a leak in the evaporative fuel processing system according to the detected pressure in the evaporative fuel processing system during a predetermined determination time period after closing the purge control valve and the vent shut valve. The leak determination of the evaporative fuel processing system is inhibited when the difference between the gas layer temperature and the ambient temperature detected upon stoppage of the engine is less than or equal to a predetermined threshold.

15 Claims, 6 Drawing Sheets

FAILURE DIAGNOSIS APPARATUS FOR EVAPORATIVE FUEL PROCESSING SYSTEM

BACKGROUND OF THE INVENTION

1. Field of the Invention

The present invention relates to a failure diagnosis apparatus for diagnosing a failure in an evaporative fuel processing system which temporarily stores evaporative fuel generated in a fuel tank and supplies the stored evaporative fuel to an internal combustion engine.

2. Related Art

If a leak occurs in an evaporative fuel processing system which temporarily stores evaporative fuel generated in a fuel tank and supplies the stored evaporative fuel to an internal combustion engine, the evaporative fuel is released into the atmosphere. Accordingly, various leak determination methods have been proposed. For example, Japanese Patent Laid-open No. Hei 11-336626 discloses a method for determining a leak after stoppage of the engine rather than during operation of the engine.

According to this conventional method, a change in a pressure difference between a pressure in an evaporative fuel processing system and atmospheric pressure is determined after stoppage of the engine. Leak determination is performed according to an amount of change in the determined pressure difference.

In this conventional method, leak determination is performed according to the amount of change in the pressure in the evaporative fuel processing system due to a change in the temperature in a fuel tank after stoppage of the engine. Accordingly, when a temperature rise in the fuel tank is insufficient, as in the case of stopping the engine immediately after starting of the engine, the temperature change after stoppage of the engine is small and the pressure change is accordingly small. In such case, there is a high possibility of improper determination.

SUMMARY OF THE INVENTION

It is accordingly an object of the present invention to provide a failure diagnosis apparatus for an evaporative fuel processing system which can prevent improper determination and improve determination accuracy when a leak determination of the evaporative fuel processing system is performed after stoppage of the engine.

The present invention provides a failure diagnosis apparatus for diagnosing a failure in an evaporative fuel processing system. The evaporative fuel processing system has a fuel tank, a canister containing an adsorbent for adsorbing evaporative fuel generated in the fuel tank, an air passage connected to the canister and communicating with the atmosphere, a first passage for connecting the canister and the fuel tank, a second passage for connecting the canister and an intake system of an internal combustion engine, a vent shut valve for opening and closing the air passage, and a purge control valve provided in the second passage. The failure diagnosis apparatus includes pressure detecting means, engine stoppage detecting means, determining means, gas layer temperature detecting means, ambient temperature detecting means, and inhibiting means. The pressure detecting means detects a pressure in the evaporative fuel processing system. The engine stoppage detecting means detects stoppage of the engine. The determining means closes the purge control valve and the vent shut valve when stoppage of the engine is detected by the engine stoppage detecting means and determines whether there is a leak in the evaporative fuel processing system according to the pressure detected by the pressure detecting means during a predetermined determination time period after closing the purge control valve and the vent shut valve. The gas layer temperature detecting means detects a gas layer temperature in the fuel tank, and the ambient temperature detecting means detects an ambient temperature. The inhibiting means inhibits the determination by the determining means when the difference between the gas layer temperature and the ambient temperature detected respectively by the gas layer temperature detecting means and the ambient temperature detecting means upon stoppage of the engine is less than or equal to a predetermined threshold value.

With this configuration, when the stoppage of the engine is detected, the purge control valve and the vent shut valve are closed and the leak determination of the evaporative fuel processing system is performed according to the pressure detected by the pressure detecting means during the predetermined determination time period after closing the purge control valve and the vent shut valve. When the difference between the gas layer temperature and the ambient temperature detected upon stoppage of the engine is less than or equal to the predetermined threshold value, the leak determination is inhibited. Accordingly, when the gas layer temperature in the fuel tank is not much higher than the ambient temperature, that is, when the engine is stopped immediately after starting, for example, the leak determination is inhibited to thereby prevent improper determination.

Preferably, the inhibiting means includes abnormality detecting means for detecting an abnormality in at least one of the pressure detecting means and the vent shut valve, and inhibits the determination by the determining means when an abnormality is detected by the abnormality detecting means.

With this configuration, the improper determination due to the abnormality in the pressure detecting means or the vent shut valve can be prevented.

Preferably, the determining means executes a first open-to-atmosphere process for maintaining the vent shut valve in an open condition immediately after detection of the stoppage of the engine to make the pressure in the evaporative fuel processing system equal to the atmospheric pressure, and further executes a first monitoring process for closing the vent shut valve after the first open-to-atmosphere process ends to determine a change in the pressure detected by the pressure detecting means after closing the vent shut valve. Then, the determining means determines that the evaporative fuel processing system is normal when the pressure detected by the pressure detecting means becomes greater than a first predetermined pressure during execution of the first monitoring process.

Preferably, the determining means executes a second open-to-atmosphere process for opening the vent shut valve after the first monitoring process ends to make the pressure in the evaporative fuel processing system equal to atmospheric pressure, and further executes a second monitoring process for closing the vent shut valve after the second open-to-atmosphere process ends to monitor a change in the pressure detected by the pressure detecting means after closing the vent shut valve. Then, the determining means determines that the evaporative fuel processing system is normal when the pressure detected by the pressure detecting means becomes less than a second predetermined pressure during execution of the second monitoring process.

Preferably, the determining means stores a maximum value of the pressure detected by the pressure detecting means during execution of the first monitoring process, and further stores a minimum value of the pressure detected by the pressure detecting means during execution of the second monitoring process. Then, the determining means determines that there exists a leak in the evaporative fuel processing system, when the difference between the stored maximum value of the pressure detected by the pressure detecting means and the stored minimum value of the pressure detected by the pressure detecting means is less than or equal to a predetermined pressure difference.

DETAILED DESCRIPTION OF THE PREFERRED EMBODIMENT

A preferred embodiment of the present invention will now be described with reference to the drawings.

Figure 1:
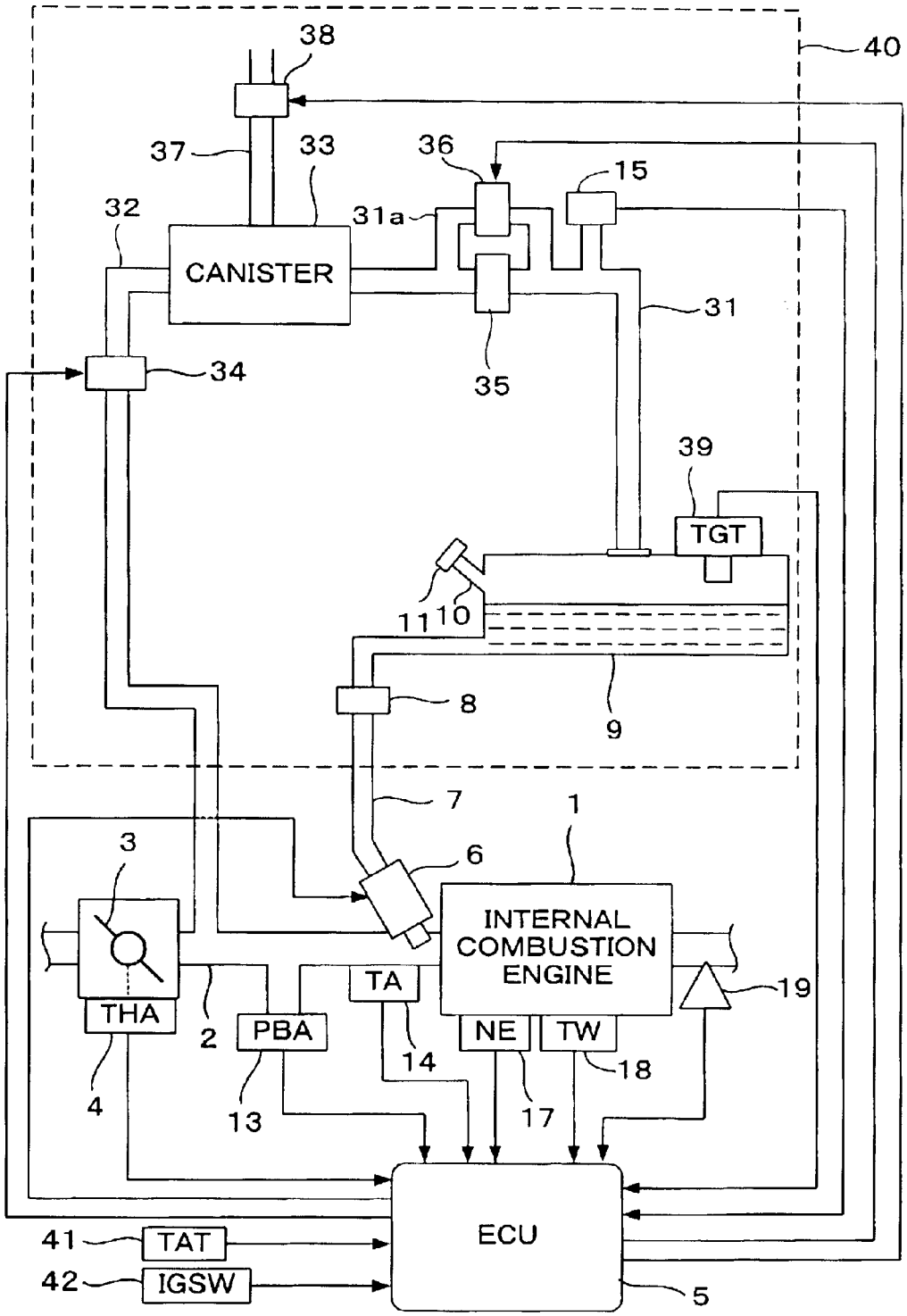
FIG. 1 is a schematic diagram showing the configuration of an evaporative fuel processing system and a control system for an internal combustion engine according to a preferred embodiment of the present invention.

FIG. 1 is a schematic diagram showing the configuration of an evaporative fuel processing system and a control system for an internal combustion engine according to a preferred embodiment of the present invention. Referring to FIG. 1, reference numeral 1 denotes an internal combustion engine (which will hereinafter be referred to as "engine") having a plurality of (e.g., four) cylinders. The engine 1 is provided with an intake pipe 2 in which a throttle valve 3 is mounted. A throttle valve opening (THA) sensor 4 is connected to the throttle valve 3. The throttle valve opening sensor 4 outputs an electrical signal corresponding to an opening of the throttle valve 3 and supplies the electrical signal to an electronic control unit (which will hereinafter be referred to as "ECU") 5.

A portion of the intake pipe 2 between the engine 1 and the throttle valve 3 is provided with a plurality of fuel injection valves 6 respectively corresponding to the plural cylinders of the engine 1 at positions slightly upstream of the respective intake valves (not shown). Each fuel injection valve 6 is connected through a fuel supply pipe 7 to a fuel tank 9. The fuel supply pipe 7 is provided with a fuel pump 8. The fuel tank 9 has a fuel filler neck 10 for use in refueling with a filler cap 11 mounted on the fuel filler neck 10.

Each fuel injection valve 6 is electrically connected to the ECU 5 and has a valve opening period controlled by a signal from the ECU 5. The intake pipe 2 is provided with an absolute intake pressure (PBA) sensor 13 and an intake air temperature (TA) sensor 14 at positions downstream of the throttle valve 3. The absolute intake pressure sensor 13 detects an absolute intake pressure PBA in the intake pipe 2. The intake air temperature sensor 14 detects an air temperature TA in the intake pipe 2.

An engine rotational speed (NE) sensor 17 for detecting an engine rotational speed is disposed near the outer periphery of a camshaft or a crankshaft (both not shown) of the engine 1. The engine rotational speed sensor 17 outputs a pulse (TDC signal pulse) at a predetermined crank angle per 180 degree rotation of the crankshaft of the engine 1. There are also provided an engine coolant temperature sensor 18 for detecting a coolant temperature TW of the engine 1 and an oxygen concentration sensor (which will hereinafter be referred to as "LAF sensor") 19 for detecting an oxygen concentration in exhaust gases from the engine 1. Detection signals from the sensors 13 to 19 are supplied to the ECU 5. The LAF sensor 19 functions as a wide-region air-fuel ratio sensor which outputs a signal substantially proportional to an oxygen concentration in exhaust gases (proportional to an air-fuel ratio of air-fuel mixture supplied to the engine 1).

An ambient temperature sensor 41 for detecting an ambient temperature TAT and an ignition switch 42 are also connected to the ECU 5. A detection signal from the ambient temperature sensor 41 and a switching signal from the ignition switch 42 are supplied to the ECU 5.

The fuel tank 9 is connected through a charging passage 31 to a canister 33. The canister 33 is connected through a purging passage 32 to the intake pipe 2 at a position downstream of the throttle valve 3.

The charging passage 31 is provided with a two-way valve 35. The two-way valve 35 includes a positive-pressure valve and a negative-pressure valve. The positive-pressure valve opens when the pressure in the fuel tank 9 is greater than atmospheric pressure by a first predetermined pressure (e.g., 2.7 kPa (20 mmHg)) or more. The negative-pressure valve opens when the pressure in the fuel tank 9 is less than the pressure in the canister 33 by a second predetermined pressure or more.

The charging passage 31 is branched to form a bypass passage 31*a* bypassing the two-way valve 35. The bypass passage 31*a* is provided with a bypass valve (on-off valve) 36. The bypass valve 36 is a solenoid valve that is normally closed, and is opened and closed during execution of a failure diagnosis to hereinafter be described. The operation of the bypass valve 36 is controlled by the ECU 5.

The charging passage 31 is further provided with a pressure sensor 15 at a position between the two-way valve 35 and the fuel tank 9. A detection signal output from the pressure sensor 15 is supplied to the ECU 5. The output PTANK of the pressure sensor 15 takes a value equal to the pressure in the fuel tank 9 in a steady state where the pressures in the canister 33 and in the fuel tank 9 are stable. The output PTANK of the pressure sensor 15 takes a value that is different from the actual pressure in the fuel tank 9 when the pressure in the canister 33 or in the fuel tank 9 is changing. The output of the pressure sensor 15 will hereinafter be referred to as "tank pressure PTANK".

The canister 33 contains active carbon for adsorbing the evaporative fuel in the fuel tank 9. A vent passage 37 is connected to the canister 33 and the canister 33 communicates with the atmosphere through the vent passage 37.

The vent passage 37 is provided with a vent shut valve (on-off valve) 38. The vent shut valve 38 is a solenoid valve, and its operation is controlled by the ECU 5 in such a manner that the vent shut valve 38 is open during refueling, or when the evaporative fuel adsorbed in the canister 33 is purged to the intake pipe 2. Further, the vent shut valve 38 is opened and closed during execution of the failure diagnosis to hereinafter be described. The vent shut valve 38 is a normally open valve which remains open when no drive signal is supplied thereto.

The purging passage 32 connected between the canister 33 and the intake pipe 2 is provided with a purge control valve 34. The purge control valve 34 is a solenoid valve capable of continuously controlling the flow rate by changing the on-off duty ratio of a control signal (by changing an opening degree of the purge control valve). The operation of the purge control valve 34 is controlled by the ECU 5.

The fuel tank 9 is provided with a gas layer temperature sensor 39 for detecting a temperature TTG of a gas layer (a gas mixture layer composed of air and evaporative fuel) inside the fuel tank 9. A detection signal from the gas layer temperature sensor 39 is supplied to the ECU 5. The temperature TTG will be referred to as "gas layer temperature".

The fuel tank 9, the charging passage 31, the bypass passage 31*a*, the canister 33, the purging passage 32, the two-way valve 35, the bypass valve 36, the purge control valve 34, the vent passage 37, and the vent shut valve 38 constitute an evaporative fuel processing system 40.

In this embodiment, even after the ignition switch 42 is turned off, the ECU 5, the bypass valve 36, and the vent shut valve 38 are kept powered during the execution period of the failure diagnosis to hereinafter be described. The purge control valve 34 is powered off to maintain a closed condition when the ignition switch 42 is turned off.

When a large amount of evaporative fuel is generated upon refueling of the fuel tank 9, the two-way valve 35 opens to facilitate the canister 33 storing the evaporative fuel. In a predetermined operating condition of the engine 1, the duty control of the purge control valve 34 is performed to supply a suitable amount of evaporative fuel from the canister 33 to the intake pipe 2.

The ECU 5 is provided with an input circuit having various functions including a function of shaping the waveforms of input signals from the various sensors, a function of correcting the voltage levels of the input signals to a predetermined level, and a function of converting analog signal values into digital signal values. The ECU 5 further includes a central processing unit (which will hereinafter be referred to as "CPU"), a memory circuit, and an output circuit. The memory circuit preliminarily stores various operational programs to be executed by the CPU and the results of computation or the like by the CPU. The output circuit supplies drive signals to the fuel injection valves 6, the purge control valve 34, the bypass valve 36, and the vent shut valve 38.

For example, the CPU in the ECU 5 controls an amount of fuel to be supplied to the engine 1 and a duty ratio of the control signal supplied to the purge control valve 34 according to output signals from the various sensors including the engine rotational speed sensor 17, the intake pipe absolute pressure sensor 13, and the engine coolant temperature sensor 18.

Figure 2:
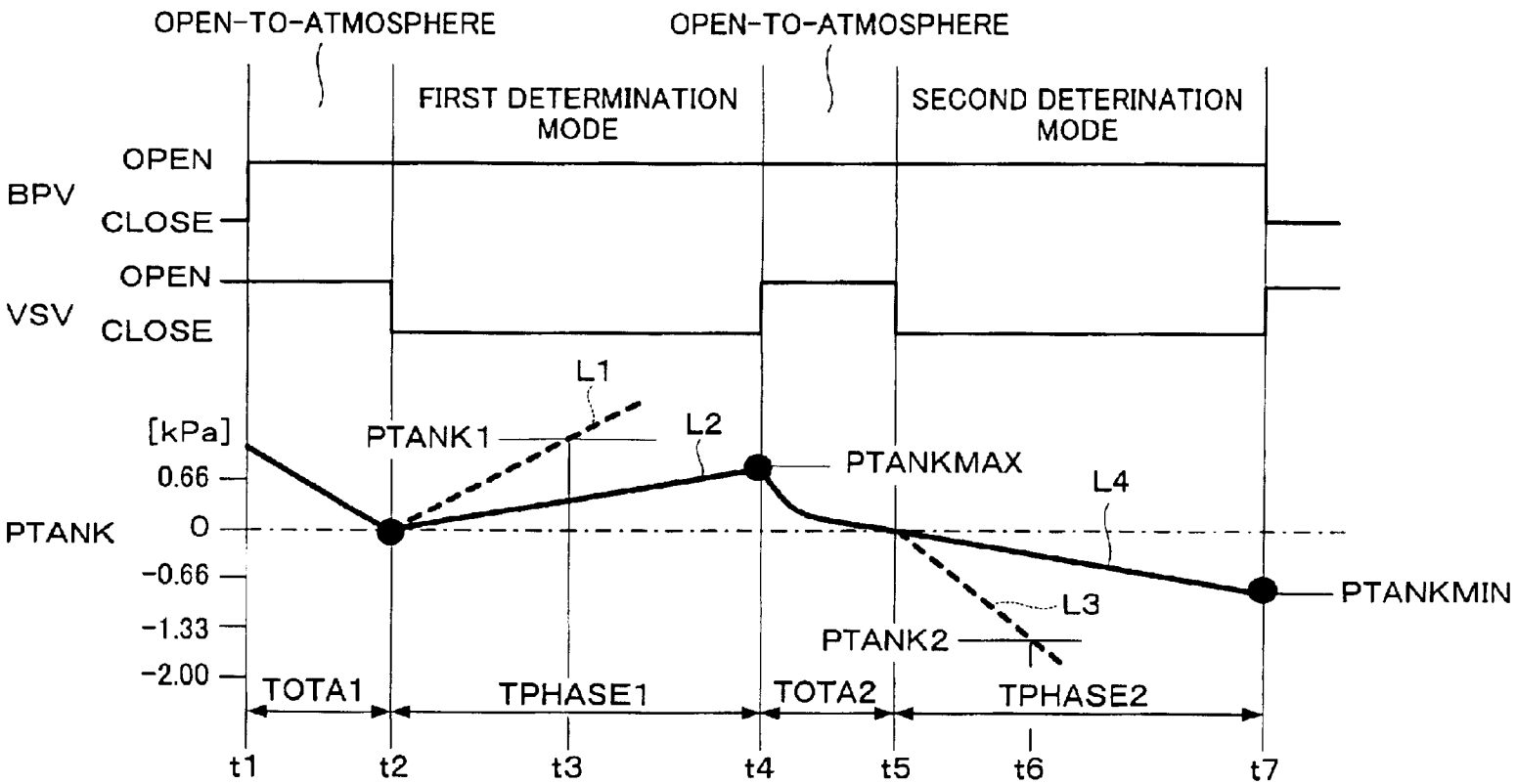
FIG. 2 is a time chart for illustrating an outline of failure diagnosis after stoppage of an engine.

FIG. 2 is a time chart for illustrating the failure diagnosis to be executed after stoppage of the engine. In FIG. 2, the tank pressure PTANK is shown as a pressure difference with respect to atmospheric pressure, although the tank pressure PTANK is actually detected as an absolute pressure.

When the engine is stopped, the bypass valve (BPV) 36 is opened and the vent shut valve (VSV) 38 is kept open (time t1). Accordingly, the evaporative fuel processing system 40 is opened to the atmosphere. When a first open-to-atmosphere time period TOTA1 has elapsed from time t1, the tank pressure PTANK becomes equal to the atmospheric pressure (time t2). The purge control valve 34 is closed when the engine is stopped.

A first determination mode is started at time t2. That is, the vent shut valve 38 is closed to thereby bring the evaporative fuel processing system 40 into a closed condition. This condition is maintained over a first determination time period TPHASE1 (e.g., 900 sec). When the tank pressure PTANK increases to become higher than a first predetermined tank pressure PTANK1 (e.g., atmospheric pressure +1.3 kPa (10 mmHg)), as shown by a broken line L1 (time t3), it is immediately determined that the evaporative fuel processing system 40 is normal (i.e., there is no leak). On the other hand, when the tank pressure PTANK changes as shown by a solid line L2, a maximum tank pressure PTANKMAX is stored (time t4).

The vent shut valve 38 is next opened at time t4 to open the evaporative fuel processing system 40 to the atmosphere.

When a second open-to-atmosphere time period TOTA2 has elapsed from time t4, a second determination mode is started at time t5. That is, the vent shut valve 38 is closed, and this condition is maintained over a second determination time period TPHASE2 (e.g., 2400 sec). When the tank pressure PTANK decreases to become lower than a second predetermined tank pressure PTANK2 (e.g., atmospheric pressure −1.3 kPa (10 mmHg)), as shown by a broken line L3 (time t6), it is immediately determined that the evaporative fuel processing system 40 is normal (i.e., there is no leak). On the other hand, when the tank pressure PTANK changes as shown by a solid line L4, a minimum tank pressure PTANKMIN is stored (time t7).

At time t7, the bypass valve 36 is closed and the vent shut valve 38 is opened. When the pressure difference ΔP between the stored maximum tank pressure PTANKMAX and the stored minimum tank pressure PTANKMIN is greater than a determination threshold ΔPTH, it is determined that the evaporative fuel processing system 40 is normal. When this pressure difference ΔP is less than or equal to the determination threshold ΔPTH, it is determined that the evaporative fuel processing system 40 has failed (i.e., there is a leak in the evaporative fuel processing system 40). This is because an amount of change in the tank pressure PTANK from the atmospheric pressure is small, that is, the pressure difference ΔP is small, when there exists a leak.

Figure 3:
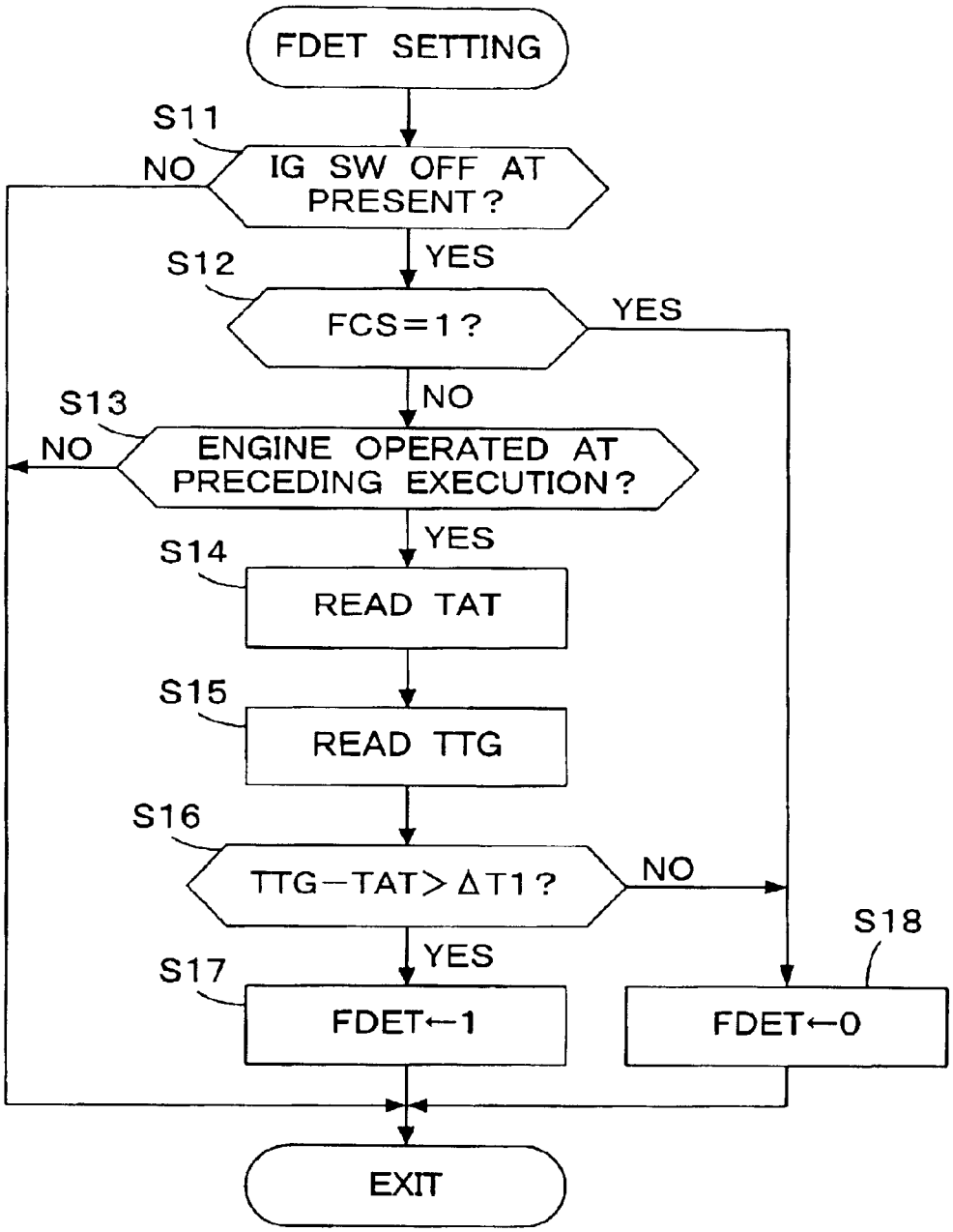
FIG. 3 is a flowchart showing a process for setting a failure diagnosis permission flag (FDET)

FIG. 3 is a flowchart showing a process for setting a failure diagnosis permission flag FDET. This process is executed by the CPU of the ECU 5 at predetermined time intervals (e.g., 100 msec).

In step S11, it is determined whether the ignition switch 42 has just been turned off (i.e., between the preceding execution and the present execution of this process). If the ignition switch 42 has not been turned off, the process immediately ends. If the ignition switch 42 has been turned off, it is determined whether an abnormality detection flag FCS is "1" (step S12). The abnormality detection flag FCS is set to "1" when a wire-disconnection or a short circuit in the pressure sensor 15, a wire-disconnection or a short circuit in the bypass valve 36, or a wire-disconnection or a short circuit in the vent shut valve 38 is detected in the process of FIG. 6.

If FCS is "1" in step S12, the process proceeds to step S18 in which the failure diagnosis permission flag FDET is set to "0" to inhibit the failure diagnosis. If FCS is "0" in step S12, it is determined whether the engine 1 was operated at the preceding execution of this process (step S13). If the answer to step S13 is negative (i.e., NO), this process immediately ends. If the answer to step S13 is affirmative (i.e., YES), which indicates that the engine 1 has just been stopped, a detected value TAT from the ambient temperature sensor 41 is read (step S14), and a detected value TTG from the gas layer temperature sensor 39 is next read (step S15).

In step S16, it is determined whether the difference (TTG−TAT) between the gas layer temperature TTG and the ambient temperature TAT is greater than a predetermined temperature difference ΔT1 (e.g., 5° C.). If the answer to step S16 is negative (i.e., NO), that is, if the difference between the gas layer temperature TTG and the ambient temperature TAT is small, the process proceeds to step S18 to inhibit the failure diagnosis, because the possibility of improper determination is high if the failure diagnosis is executed in this case. If the answer to step S16 is affirmative (i.e., YES), the failure diagnosis permission flag FDET is set to "1" (step S17) to permit failure diagnosis.

According to the process of FIG. 3, failure diagnosis after stoppage of the engine is inhibited if the difference (TTG−TAT) between the gas layer temperature TTG and the ambient temperature TAT is less than or equal to the predetermined temperature difference Δ T1. Accordingly, improper determination is prevented and determination accuracy improved.

Figure 4:
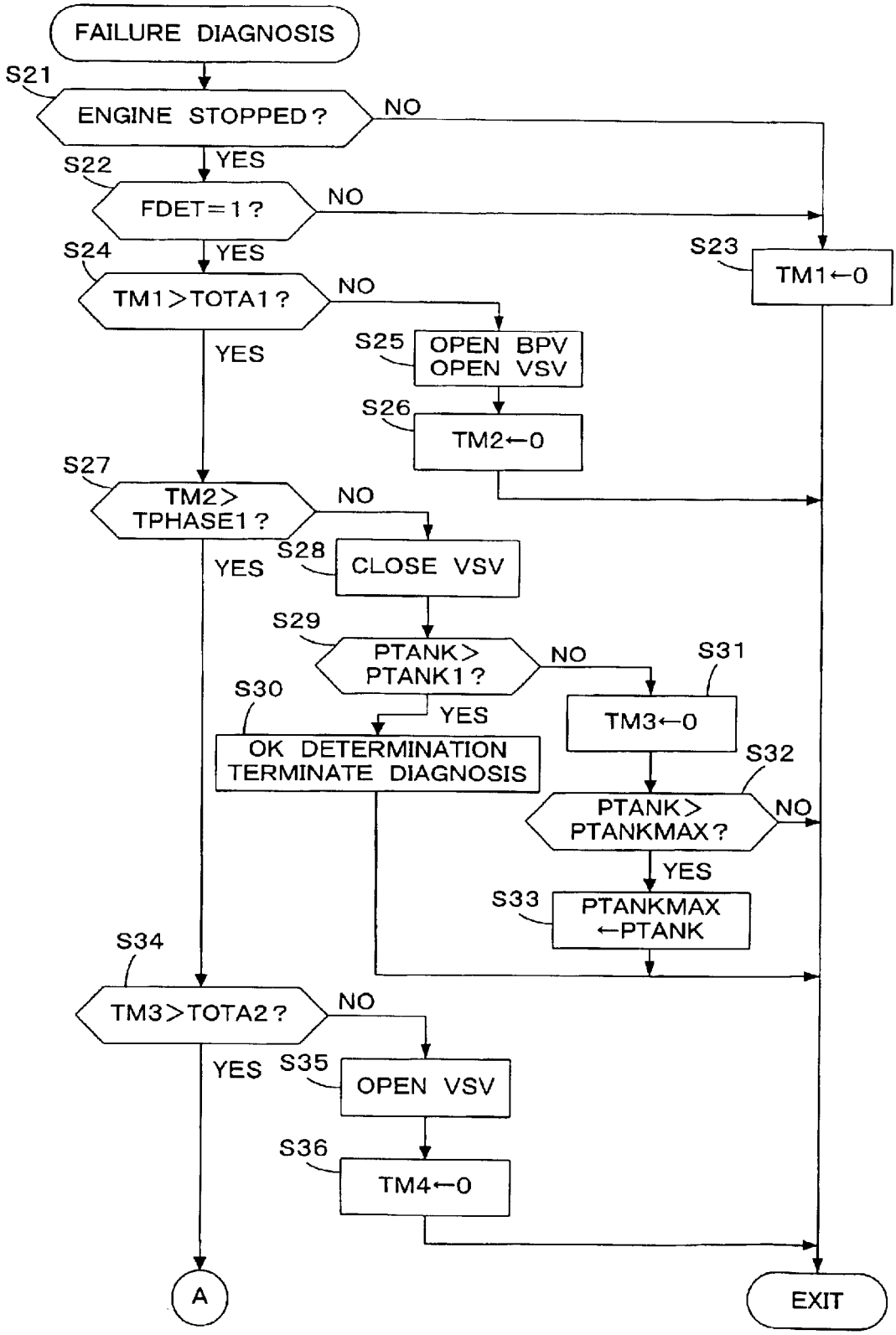
FIGS. 4 and 5 are flowcharts showing a process for executing failure diagnosis.
Figure 5:
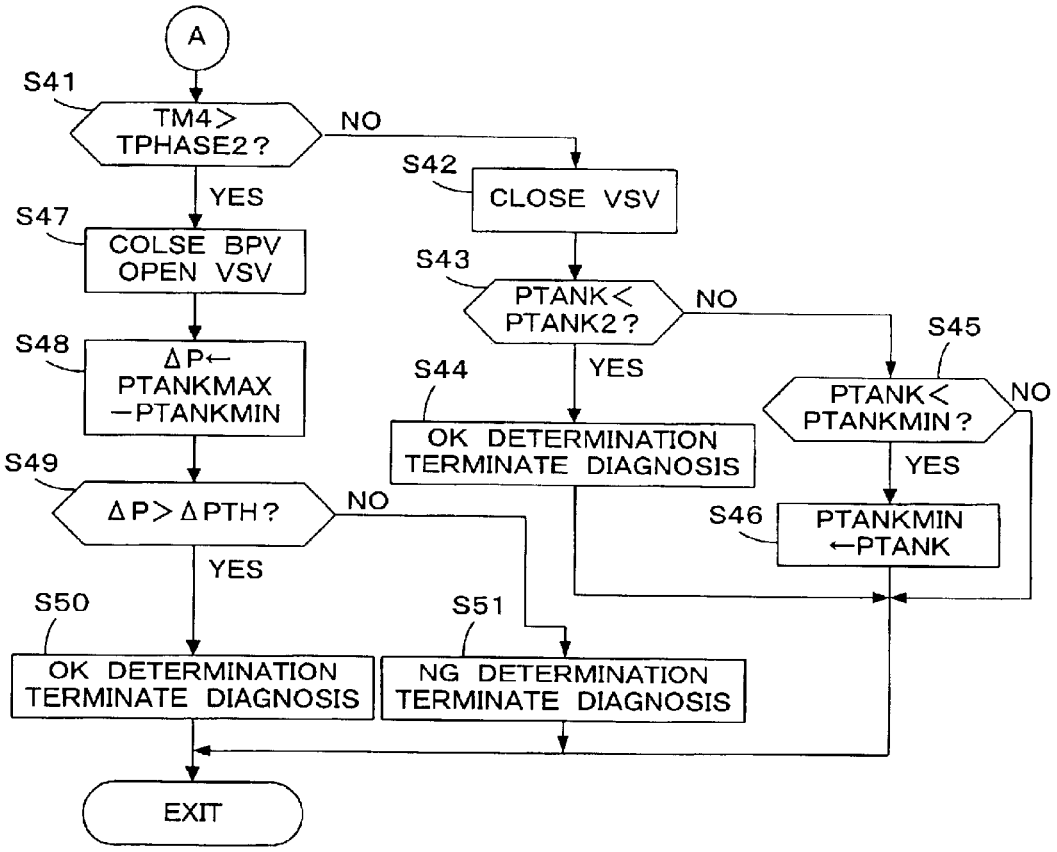

FIGS. 4 and 5 are flowcharts showing a process for executing failure diagnosis. This process is executed by the CPU of the ECU 5 at predetermined time intervals (e.g., 100 msec).

In step S21, it is determined whether the engine 1 has been stopped. If the engine 1 is operating, the value of a first upcount timer TM1 is set to "0" (step S23) and this process ends. If the engine 1 has been stopped, the process proceeds from step S21 to step S22 to determine whether the failure diagnosis permission flag FDET is "1". If FDET is "0", the process proceeds to step S23. If FDET is "1", it is determined whether the value of the first upcount timer TM1 is greater than the first open-to-atmosphere time period TOTAL (e.g., 120 sec) (step S24). Initially, the answer to step S24 is negative (NO), so that the bypass valve 36 is opened and the open condition of the vent shut valve 38 is maintained (step S25) (time t1 in FIG. 2). Thereafter, the value of a second upcount timer TM2 is set to "0" (step S26), and this process ends.

When the value of the first upcount timer TM1 reaches the first open-to-atmosphere time period TOTA1 (time t2 in FIG. 2), the process proceeds from step S24 to step S27 to determine whether the value of the second upcount timer TM2 is greater than the first determination time period TPHASE1. Initially, the answer to step S27 is negative (NO), so that the vent shut valve 38 is closed (step S28). It is then determined whether the tank pressure PTANK is higher than the first predetermined tank pressure PTANK1 (step S29). Initially, the answer to step S29 is negative (NO), so that the value of a third upcount timer TM3 is set to "0" (step S31). It is then determined whether or not the tank pressure PTANK is greater than the maximum tank pressure PTANKMAX (step S32). Since the initial value of the maximum tank pressure PTANKMAX is preliminarily set to a value less than the atmospheric pressure, the answer to step S32 is initially affirmative (YES). Accordingly, the maximum tank pressure PTANKMAX is set to the present tank pressure PTANK (step S33). If the answer to step S32 is negative (NO), this process immediately ends. Thus, the steps S32 and S33 provide the maximum tank pressure PTANKMAX in the first determination mode.

When the answer to step S29 becomes affirmative (YES) (time t3 in FIG. 2, see the broken line L1), it is determined that the rate of increase in the tank pressure PTANK is relatively high and that the evaporative fuel processing system 40 is normal (there is no leak) (step S30). Then, the failure diagnosis ends.

When the value of the second upcount timer TM2 reaches the first determination time period TPHASE1 (time t4 in FIG. 2), the process proceeds from step S27 to step S34. In step S34, it is determined whether the value of the third upcount timer TM3 is greater than the second open-to-atmosphere time period TOTA2 (e.g., 120 sec). Initially, the answer to step S34 is negative (NO), so that the vent shut valve 38 is opened (step S35), and the value of a fourth upcount timer TM4 is set to "0" (step S36). Then, this process ends.

When the value of the third upcount timer TM3 reaches the second open-to-atmosphere time period TOTA2 (time t5 in FIG. 2), the process proceeds from step S34 to step S41 (shown in FIG. 5) to determine whether the value of the fourth upcount timer TM4 is greater than the second determination time period TPHASE2. Initially, the answer to step S41 is negative (NO) so that the vent shut valve 38 is closed (step S42). It is then determined whether the tank pressure PTANK is lower than the second predetermined tank pressure PTANK2 (step S43). Initially, the answer to step S43 is negative (NO) so that it is determined whether the tank pressure PTANK is lower than the minimum tank pressure PTANKMIN (step S45). Since the initial value of the minimum tank pressure PTANKMIN is preliminarily set to a value higher than the atmospheric pressure, the answer to step S45 is initially affirmative (YES). Accordingly, the minimum tank pressure PTANKMIN is set to the present tank pressure PTANK (step S46). If the answer to step S45 is negative (NO), this process immediately ends. Thus, the steps S45 and S46 provide the minimum tank pressure PTANKMIN in the second determination mode.

When the answer to step S43 becomes affirmative (YES) (time t6 in FIG. 2, see the broken line L3), it is determined that the rate of decrease in the tank pressure PTANK is relatively high and that the evaporative fuel processing system 40 is normal (there is no leak) (step S44). Then, the failure diagnosis ends.

When the value of the fourth upcount timer TM4 reaches the second determination time period TPHASE2 (time t7 in FIG. 2), the bypass valve 36 is closed and the vent shut valve 38 is opened (step S47). Thereafter, the pressure difference ΔP (PTANKMAX−PTANKMIN) between the maximum tank pressure PTANKMAX and the minimum tank pressure PTANKMIN is calculated (step S48). It is then determined whether the pressure difference ΔP is greater than the determination threshold ΔPTH (step S49). If ΔP is greater than ΔPTH, it is determined that the evaporative fuel processing system 40 is normal and the failure diagnosis ends (step S50). If ΔP is less than or equal to ΔPTH, it is determined that the evaporative fuel processing system 40 has failed (i.e., there is a leak in the evaporative fuel processing system 40) and the failure diagnosis ends (step S51).

Figure 6:
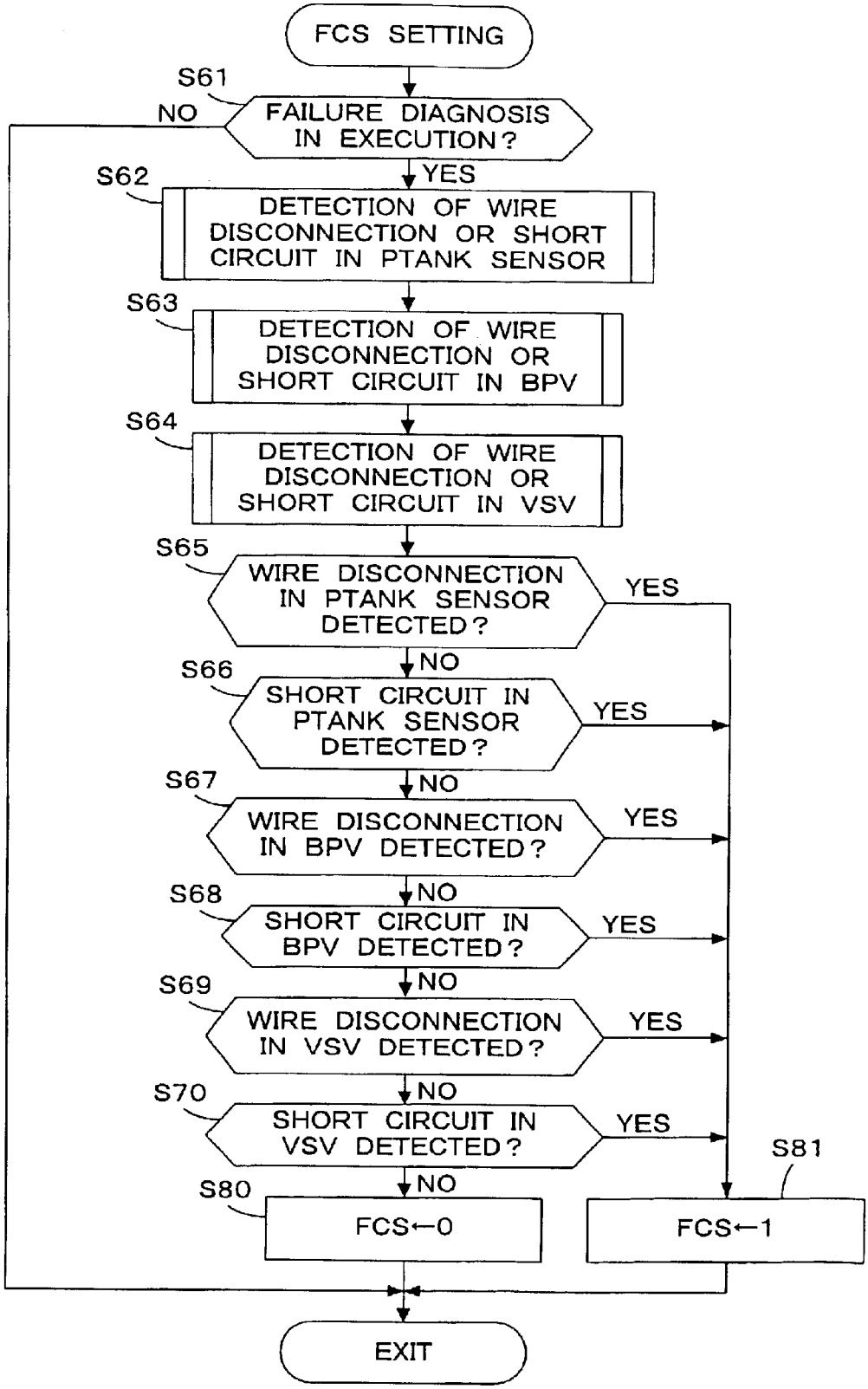
FIG. 6 is a flowchart showing a process for setting an abnormality detection flag (FCS).

FIG. 6 is a flowchart showing a process for setting the abnormality detection flag FCS. This process is executed by the CPU of the ECU 5 at predetermined time intervals (e.g., 100 msec).

In step S61, it is determined whether the failure diagnosis process of FIGS. 4 and 5 is in execution. If the failure diagnosis process is not in execution, this process immediately ends. If the failure diagnosis process is in execution, the following steps S62 to S81 are executed.

In step S62, a process for detecting a wire-disconnection or a short circuit in the pressure sensor 15 is executed. In this process, a wire-disconnection or a short circuit is detected according to the output voltage and output current from the pressure sensor 15. In step S63, a process for detecting a wire-disconnection or a short circuit in the bypass valve 36 is executed. In this process, a wire-disconnection or a short circuit is detected according to the input voltage and input current to the bypass valve 36. In step S64, a process for detecting a wire-disconnection or a short circuit in the vent shut valve 38 is executed. In this process, a wire-disconnection or a short circuit is detected according to the input voltage and input current to the vent shut valve 38.

Thereafter, it is determined whether or not a wire-disconnection in the pressure sensor 15 has been detected (step S65). If the answer to step S65 is negative (NO), it is then determined whether a short circuit in the pressure sensor 15 has been detected (step S66). If the answer to step S66 is negative (NO), it is then determined whether a wire-disconnection in the bypass valve 36 has been detected (step S67). If the answer to step S67 is negative (NO), it is then determined whether a short circuit in the bypass valve 36 has been detected (step S68). If the answer to step S68 is negative (NO), it is then determined whether a wire-disconnection in the vent shut valve 38 has been detected (step S69). If the answer to step S69 is negative (NO), it is then determined whether a short circuit in the vent shut valve 38 has been detected (step S70).

If the answer to any one of steps S65 to S70 is affirmative (YES), the abnormality detection flag FCS is set to "1" (step S81). If the answers to all of steps S65 to S70 are negative (NO), the abnormality detection flag FCS is set to "0" (step S80).

In this manner, when a wire-disconnection or a short circuit in the pressure sensor 15, the bypass valve 36, or the vent shut valve 38, which are directly relevant to the execution of the failure diagnosis, is detected, the abnormality detection flag FCS is set to "1" to inhibit the failure diagnosis. Accordingly, it is possible to prevent improper determination due to the abnormality (e.g., a wire-disconnection or a short circuit) in the pressure sensor 15, the bypass valve 36, or the vent shut valve 38.

In this embodiment, the ECU 5 is the determining means, the inhibiting means, and the abnormality detecting means. More specifically, the process of FIGS. 4 and 5 corresponds to the determining means. Steps S16 to S18 in FIG. 3 correspond to the inhibiting means. The process of FIG. 6 corresponds to the abnormality detecting means. Further, the pressure sensor 15 corresponds to the pressure detecting means for detecting the pressure in the evaporative fuel processing system. The gas layer temperature sensor 39 and the ambient temperature sensor 41 correspond respectively to the gas layer temperature detecting means and the ambient temperature detecting means.

In the above described embodiment, the ambient temperature sensor 41 is provided additionally to the intake air temperature sensor 14. Alternatively, the intake air temperature TA detected by the intake air temperature sensor 14 may be used as the ambient temperature TAT. Further, in the above described embodiment, the pressure sensor 15 is provided in the charging passage 31. Alternatively, the pressure sensor 15 may be provided in the fuel tank 9.

The present invention may be embodied in other specific forms without departing from the spirit or essential characteristics thereof. The presently disclosed embodiment is therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A failure diagnosis apparatus for diagnosing a failure in an evaporative fuel processing system having a fuel tank, a canister containing an adsorbent for adsorbing evaporative fuel generated in said fuel tank, an air passage connected to said canister and communicating with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis apparatus comprising:

pressure detecting means for detecting a pressure in said evaporative fuel processing system;

engine stoppage detecting means for detecting stoppage of said engine;

determining means for closing said purge control valve and said vent shut valve when stoppage of said engine is detected by said engine stoppage detecting means, and determining whether there is a leak in said evaporative fuel processing system according to the pressure detected by said pressure detecting means during a predetermined determination time period after closing said purge control valve and said vent shut valve;

gas layer temperature detecting means for detecting a gas layer temperature in said fuel tank;

ambient temperature detecting means for detecting an ambient temperature; and inhibiting means for inhibiting the determination by said determining means when a difference between the gas layer temperature and the ambient temperature detected respectively by said gas layer temperature detecting means and said ambient temperature detecting means upon stoppage of said engine is less than or equal to a predetermined threshold value.

2. The failure diagnosis apparatus according to claim 1, wherein said inhibiting means includes abnormality detecting means for detecting an abnormality in at least one of said pressure detecting means and said vent shut valve, and inhibits the determination by said determining means when an abnormality is detected by said abnormality detecting means.

3. The failure diagnosis apparatus according to claim 1, wherein said determining means executes a first open-to-atmosphere process for maintaining said vent shut valve in an open condition immediately after detection of the stoppage of said engine to make the pressure in said evaporative fuel processing system equal to atmospheric pressure, and executes a first monitoring process for closing said vent shut valve after an end of said first open-to-atmosphere process to monitor a change in the pressure detected by said pressure detecting means after closing said vent shut valve; and said determining means determines that said evaporative fuel processing system is normal when the pressure detected by said pressure detecting means becomes greater than a first predetermined pressure during execution of said first monitoring process.

4. The failure diagnosis apparatus according to claim 3, wherein said determining means executes a second open-to-atmosphere process for opening said vent shut valve after said first monitoring process ends to make the pressure in said evaporative fuel processing system equal to the atmospheric pressure, and executes a second monitoring process for closing said vent shut valve after said second open-to-atmosphere process ends to monitor a change in the pressure detected by said pressure detecting means after closing said vent shut valve; and said determining means determines that said evaporative fuel processing system is normal when the pressure detected by said pressure detecting means becomes less than a second predetermined pressure during execution of said second monitoring process.

5. The failure diagnosis apparatus according to claim 4, wherein said determining means stores a maximum value of the pressure detected by said pressure detecting means during execution of said first monitoring process, and stores a minimum value of the pressure detected by said pressure detecting means during execution of said second monitoring process; and said determining means determines there is a leak in said evaporative fuel processing system when the difference between the stored maximum value of the pressure detected by said pressure detecting means and the stored minimum value of the pressure detected by said pressure detecting means is less than or equal to a predetermined pressure difference.

6. A failure diagnosis method for diagnosing a failure in an evaporative fuel processing system having a fuel tank, a canister containing an adsorbent for adsorbing evaporative fuel generated in said fuel tank, an air passage connected to said canister and communicating with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis method comprising the steps of:

a) detecting a pressure in said evaporative fuel processing system by a pressure sensor;

b) detecting stoppage of said engine;

c) closing said purge control valve and said vent shut valve when stoppage of said engine is detected by said engine stoppage detecting means;

d) determining whether there is a leak in said evaporative fuel processing system according to the pressure detected by said pressure sensor during a predetermined determination time period after closing said purge control valve and said vent shut valve;

e) detecting a gas layer temperature in said fuel tank;

f) detecting an ambient temperature; and g) inhibiting the leak determination at said step d) when a difference between the gas layer temperature and the ambient temperature detected upon stoppage of said engine is less than or equal to a predetermined threshold value.

7. The failure diagnosis method according to claim 6, further includes a step of detecting an abnormality in at least one of said pressure sensor and said vent shut valve, wherein the leak determination at said step d) is inhibited when an abnormality in at least one of said pressure sensor and said vent shut valve is detected.

8. The failure diagnosis method according to claim 6, wherein said step d) includes steps of executing a first open-to-atmosphere process for maintaining said vent shut valve in an open condition immediately after detecting stoppage of said engine to make the pressure in said evaporative fuel processing system equal to atmospheric pressure, and executing a first monitoring process for closing said vent shut valve after said first open-to-atmosphere process ends to monitor a change in the pressure detected by said pressure detecting means after closing said vent shut valve, and determining that said evaporative fuel processing system is normal when the pressure detected by said pressure sensor becomes greater than a first predetermined pressure during execution of said first monitoring process.

9. The failure diagnosis method according to claim 8, wherein said step d) further includes steps of executing a second open-to-atmosphere process for opening said vent shut valve after said first monitoring process ends to make the pressure in said evaporative fuel processing system equal to the atmospheric pressure, and further executing a second monitoring process for closing said vent shut valve after said second open-to-atmosphere process ends to monitor a change in the pressure detected by said pressure detecting means after closing said vent shut valve; and determining that said evaporative fuel processing system is normal when the pressure detected by said pressure sensor becomes less than a second predetermined pressure during execution of said second monitoring process.

10. The failure diagnosis method according to claim 9, wherein said step d) includes steps of storing a maximum value of the pressure detected by said pressure sensor during execution of said first monitoring process and storing a minimum value of the pressure detected by said pressure sensor during execution of said second monitoring process, and determining there is a leak in said evaporative fuel processing system when the difference between the stored maximum value of the pressure detected by said pressure sensor and the minimum value of the pressure detected by said pressure sensor stored above is less than or equal to a predetermined pressure difference.

11. A failure diagnosis apparatus for diagnosing a failure in an evaporative fuel processing system having a fuel tank, a canister containing an adsorbent for adsorbing evaporative fuel generated in said fuel tank, an air passage connected to said canister and communicating with the atmosphere, a first passage for connecting said canister and said fuel tank, a second passage for connecting said canister and an intake system of an internal combustion engine, a vent shut valve for opening and closing said air passage, and a purge control valve provided in said second passage, said failure diagnosis apparatus comprising:

a pressure sensor for detecting a pressure in said evaporative fuel processing system;

an engine stoppage detecting module for detecting stoppage of said engine;

a determining module for closing said purge control valve and said vent shut valve when stoppage of said engine is detected by said engine stoppage detecting module, and determining whether there is a leak in said evaporative fuel processing system according to the pressure detected by said pressure sensor during a predetermined determination time period after closing said purge control valve and said vent shut valve;

a gas layer temperature sensor for detecting a gas layer temperature in said fuel tank;

an ambient temperature sensor for detecting an ambient temperature; and an inhibiting module for inhibiting the determination by said determining module when a difference between the gas layer temperature and the ambient temperature detected respectively by said gas layer temperature sensor and said ambient temperature sensor upon stoppage of said engine is less than or equal to a predetermined threshold value.

12. The failure diagnosis apparatus according to claim 11, wherein said inhibiting module includes an abnormality detecting module for detecting an abnormality in at least one of said pressure sensor and said vent shut valve and inhibits the determination by said determining module when an abnormality is detected by said abnormality detecting module.

13. The failure diagnosis apparatus according to claim 11, wherein said determining module executes a first open-to-atmosphere process for maintaining said vent shut valve in an open condition immediately after detecting stoppage of said engine to make the pressure in said evaporative fuel processing system equal to atmospheric pressure, and further executes a first monitoring process for closing said vent shut valve after said first open-to-atmosphere process ends to monitor a change in the pressure detected by said pressure sensor after closing said vent shut valve; and said determining module determines that said evaporative fuel processing system is normal when the pressure detected by said pressure sensor becomes greater than a first predetermined pressure during execution of said first monitoring process.

14. The failure diagnosis apparatus according to claim 13, wherein said determining module executes a second open-to-atmosphere process for opening said vent shut valve after said first monitoring process ends to make the pressure in said evaporative fuel processing system equal to the atmospheric pressure, and further executes a second monitoring process for closing said vent shut valve after said second open-to-atmosphere process ends to monitor a change in the pressure detected by said pressure sensor after closing said vent shut valve; and said determining module determines that said evaporative fuel processing system is normal when the pressure detected by said pressure sensor becomes less than a second predetermined pressure during execution of said second monitoring process.

15. The failure diagnosis apparatus according to claim 14, wherein said determining module stores a maximum value of the pressure detected by said pressure sensor during execution of said first monitoring process, and further stores a minimum value of the pressure detected by said pressure sensor during execution of said second monitoring process; and said determining module determines there is a leak in said evaporative fuel processing system, when the difference between the stored maximum value of the pressure detected by said pressure sensor and the stored minimum value of the pressure detected by said pressure sensor is less than or equal to a predetermined pressure difference.

* * * * *